United States Patent [19]

Prueher

[11] 4,245,752

[45] Jan. 20, 1981

[54] LID FOR DRINKING CONTAINER

[76] Inventor: Andrew B. Prueher, 1016 N. Sheridan, Highland Park, Ill. 60035

[21] Appl. No.: 60,904

[22] Filed: Jul. 26, 1979

Related U.S. Application Data

[63] Continuation-in-part of Ser. No. 947,063, Sep. 29, 1978, abandoned, which is a continuation-in-part of Ser. No. 882,670, Mar. 2, 1978, abandoned.

[51] Int. Cl.[3] ..... A47G 19/22; B65D 47/08; B65D 47/10

[52] U.S. Cl. ..... 220/266; 128/252; 215/311; 220/90.4; 222/490; 222/541

[58] Field of Search ..... 220/90.2, 90.4, 266; 128/252; 222/490, 570, 541; 215/307, 311, 253

[56] References Cited

U.S. PATENT DOCUMENTS

| | | | |
|---|---|---|---|
| 956,741 | 5/1910 | Smith | 128/252 |
| 1,144,980 | 6/1915 | Hilton | 128/252 |
| 2,075,249 | 3/1937 | Wilson | 222/490 X |
| 2,122,299 | 6/1938 | Sloan | 222/490 |
| 2,263,890 | 11/1941 | Saluesen | 222/490 X |
| 2,316,516 | 4/1943 | Hammerstein | 222/490 |
| 2,520,684 | 8/1950 | Herzos | 222/490 |
| 2,550,568 | 4/1951 | Kersh | 128/252 |
| 2,733,843 | 2/1956 | Seroko | 128/252 X |
| 2,761,593 | 9/1956 | Spiess, Jr. et al. | 222/490 X |
| 2,816,548 | 12/1957 | Tupper | 128/252 |
| 2,893,611 | 7/1959 | Akers | 222/541 X |
| 2,927,708 | 3/1960 | Kristoffersen | 128/252 X |
| 3,085,710 | 4/1963 | McIlroy | 215/307 X |
| 3,471,058 | 10/1969 | Latham et al. | 222/570 X |
| 3,895,743 | 7/1975 | Christian | 222/570 X |

FOREIGN PATENT DOCUMENTS

| | | | |
|---|---|---|---|
| 996998 | 12/1951 | France | 222/490 |
| 99572 | 8/1940 | Sweden | 222/490 |
| 1046518 | 10/1966 | United Kingdom | 222/490 |

*Primary Examiner*—Allan N. Shoap
*Attorney, Agent, or Firm*—Alter and Weiss

[57] ABSTRACT

An improved lid for covering containers, such as tumblers or the like, has a mouthpiece with at least a portion of the mouthpiece shaped to fit within the lips of a person drinking from the container. The mouthpiece has a valve therein operated by the drinker's lips or by the application of pressure on opposite sides of resilient walled containers. The mouthpiece with valve on the lid prevents spilling of the liquid, if the container is accidentally dropped, precludes spilling of the liquid during the time the drinker is engaged in drinking the liquid from the container, even when the drinking is done under adverse conditions, and provides facilitated means for adding condiments to a hot beverage for consumption by a user. Features are further provided for more effectively securing the valve to preclude inadvertent spilling from "wave action" of the liquid within the container. Means are further provided to enable the user to sense the temperature of the liquid immediately before liquid is released from the container.

15 Claims, 9 Drawing Figures

LID FOR DRINKING CONTAINER

This is a continuation-in-part application from my earlier filed parent application having Ser. No. 947,063, filed Sept. 29, 1978, which was in turn a continuation-in-part application from my earlier filed parent application, Ser. No. 882,670, filed Mar. 2, 1978, both of which are now abandoned.

This invention generally relates to improvements in drinking containers; and more particularly, is concerned with the lids for the drinking containers normally provided at fast food service establishments.

The containers provided by the fast food establishments are often used in the purchaser's automobile. Many times children are in the vehicle and also partaking of the food and the drink obtained at the fast food service establishment. In such cramped quarters, the drinking containers are invariably knocked down and the contents spilled, messing up the children, the parents and the automobile.

Also, it often happens that, while the vehicle is moving, one of the passengers may still be using the drinking container. Accordingly, drinking containers and attachments for drinking containers which will prevent inadvertent spilling, when being used for drinking and while awaiting the use for drinking, have long been sought.

An example of a prior art device for making liquid container spill-proof is the device shown in the R. B. Smith U.S. Pat. No. 3,015,411. The Smith patent shows a disk shaped closure plate for a basically cylindrical container which is operable to a closed condition from any position about the perimeter of the container. The closure plate is attached at its center point to a spring device and held by the spring forces against flanges extending over the top of the container.

While the Smith device prevents spilling, if the container is accidentally knocked down, it does nothing to prevent spilling during use; in fact, because of the flanges, there is created the tendency for the liquid to spill, unless extraordinary care is taken, when using the Smith spill-proof device. Further, attaching the spring mounted disk to the container is relatively complicated.

Another type of prior art drinking container lid is represented by McIlroy U.S. Pat. No. 3,085,710 which teaches attachments for drinking containers to control the flow of liquid from the container during the drinking process. The attachment comprises a lid with a defining wall portion forming a solid, single walled spout extending from the periphery of the lid. The lid itself has a normally closed valve which is opened by the finger of the drinker through pressing on the sides of the container. Also, the construction does not lend itself to being disposable—the threads and taper require expensive injection molding rather than, for instance, vacuum formed plastic of the disposable type. Therefore, among other things, the attachment of McIlroy cannot be used with plastic disposable containers, as with plastic disposable cups, as used in the fast food industry, for example.

Accordingly, an object of the present invention is to provide new and improved lids for drinking containers.

A related object of the present invention is to provide lids having an upwardly extending mouthpiece which includes a valve thereby facilitating control of the flow of liquid from the container with the lips of the drinker.

A related object of the present invention is to provide improved lids for drinking containers having new and improved valves thereon, whereby the liquid is substantially retained in the container notwithstanding inadvertent tipping of the container.

Another object of the present invention is to provide new and improved lids for the plastic tumblers provided by fast food service establishments to improve the usability of such containers in closely confined spaces, such as automobiles, and other such vehicles.

Yet another object of the present invention is to provide valved lids that cost no more than conventional disposable lids.

Still another object of the present invention is to provide disposable lids with the valve so shaped as to make the lid formable by vacuum and pressure forming. In one embodiment the valve itself is cup shaped to offer further resistance to inadvertent opening and to dampen the wave action of a filled container or to alternatively prevent ice in chilled drinks from emerging. Such a construction further enables safe sampling of the drink's temperature through the double-walled construction of an emanating mouthpiece proximate to the valve.

Additionally, it is a related object of the present invention to provide new and improved lids for containers used by fast food establishments, which lids prevent spilling the contents from containers that have been upset and enable the user to drink therefrom without spilling the contents, even when the drinking is done under adverse conditions, such as moving vehicles, or even while driving.

Further, it is an object of the present invention to provide an improved lid with the previously mentioned advantages which enables a user to add various condiments to hot drinks such as cream and sugar to coffee in a facilitated manner while providing a structure capable of cooling such a hot beverage before being consumed by the user.

In one embodiment of the present invention, the new and improved lid comprises a mouthpiece extending upwardly from one peripheral edge of the lid. The mouthpiece is characterized to fit comfortably in the mouth of the average individual and enable that individual user to operate a valve integral to the mouthpiece with his lips. The valve controls the flow of liquid in the container during the drinking process. Alternatively, the user can squeeze the sides of the container to pump a thick liquid, such as a milk shake, through the valve operated by the pressure of the squeezing.

The valve prevents egress of the liquid in the container in case of inadvertent tipping of the container. The valve is opened by pressure on both sides of the container or pressure on the mouthpiece either by the lips or fingers of the user.

In another embodiment of the invention, the mouthpiece has formed proximate to it, a flapped valve assembly. This assembly remains closed until the user desires to drink the beverage contained by the container. By exerting pressure inwardly on the container, sealing shoulders in this embodiment, give way to release the flap from its seated position, hinging it downwardly. In a preferred embodiment of the invention, the flap comprises a substantially cup-shaped member wherein the open portion of the cup is positioned to face inwardly towards the contents of the container. The aforementioned sealing shoulder proximately surrounds the cup-shaped member except at a position closest to the center of the lid at which point the cup-shaped member can pivot once the "break away" shoulders are severed through applied pressure from the lips or fingers of the user.

The cup-shaped construction for the flap itself imparts several advantages to this particular embodiment. Particularly, this construction assists the flap member in pivoting back to its closed position proximate to the severed shoulders when liquid within the container splashes against the flapped member. Additionally, when the container has substantial quantities of liquid contained therein, the cup-shaped member serves to dampen the "wave action" of the fluid which is often imparted by even nominal movement of the container itself. Further, the cup-shaped flap member more effectively "catches" silvers, chunks or flakes of ice within a chilled beverage which would otherwise more easily inadvertently emerge from the container aperture. The cup-shaped flap member facilitates forcing the flap open by pressing on the portion of the flap adjacent the hinge thereby assuring that neither the user's fingers nor the flap portion touched by the fingers enters the contained fluid.

The specific double walled construction of the mouthpiece serves yet another purpose. Through such a construction of the mouthpiece, preferably of a material approximately 10 mils in thickness, a user is able to sense through his lips the temperature of the liquid as the liquid fills the space between the walls of the mouthpiece. As this liquid will fill the interior portion of the mouthpiece, immediately prior to emerging through the aperture after the container is tipped, a user is apprised of the liquid's temperature immediately prior to consuming the liquid.

In either embodiment of the flapped valve, the valve stays open to allow the introduction of condiments by the user into the beverage as in the case wherein cream and sugar is added to coffee. These embodiments can thus be seen to be especially directed to hot beverages wherein the beverage is additionally cooled as it cascades over the mouthpiece before entering the consumer's mouth. The heat of such a hot beverage is capable of further reducing the plastic "memory" of the flap portion as it hinges about the fixed connection so as to retard its return to the sealed position. While this feature is favorable, it can be seen that is is even more important that the flap be of such a construction to effectively seal if splashed against.

These and other objects and features of the invention and the manner of obtaining them will be best understood by making reference to the accompanying drawings, in which.

Figure 1:
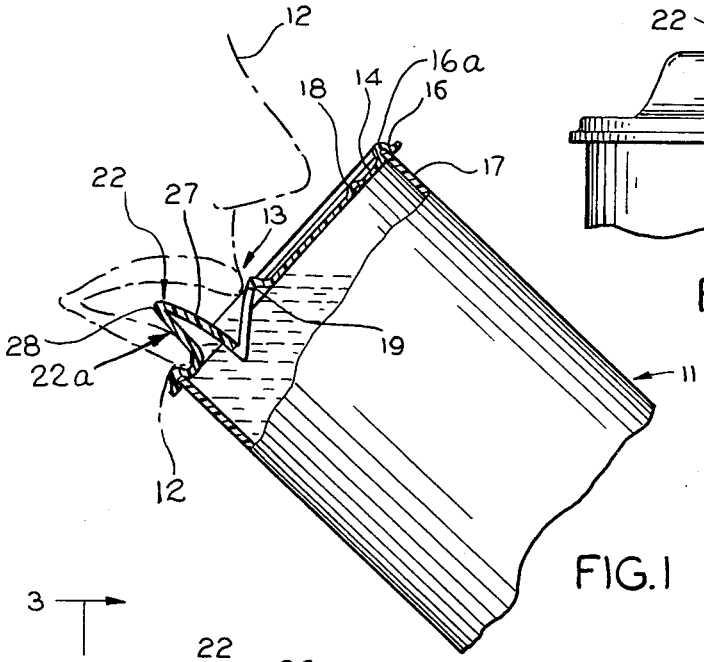
FIG. 1 is a partial sectional side view of the container showing a user tilting the container so that the mouthpiece of the first embodiment is juxtaposed to the lips of the user.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

In FIG. 1 the container 11 is shown in a tilted position enabling the user 12, indicated in dashed line form, to place mouthpiece area 13 of the lid 14 juxtaposed to the user's lips. The lid is shown as having a peripheral channel 16 dimensioned to enable the lid to be clamped onto the walls 17 of the cylindrically shaped or frusto-conically shaped tumbler or drinking container, such as are commonly used by the many fast food establishments proliferating the country. The peripheral channel 16 extends upward to form a peripheral ridge **16*a***.

The lid 14 is shown as having a decorative looking ridge 18 extending arculately from one side of the mouthpiece to the other. The diameter of the decorative ridge 18 is less than the diameter extending to the outer circumference of the lid.

The mouthpiece area 13 is integral to the lid. The mouthpiece area 13 is bordered on one side by an inner definitive ridge 19 which extends upwardly from the top of the lid to form a quasti-triangular basin 20 which descends from the top of ridge 19 back to the surface of the lid at juncture 21. The descent is preferably arcuate in form; i.e., defining a globular section.

Rising from the bottom of the basin is a peripheral bottom lip engaging mouthpiece member 22. The mouthpiece member 22 defines the outer perimeter of the basin and is shown positioned slightly inward of the peripheral ridge **16*a*. Mouthpiece 22 has outer surface 22*a* and inner surface 27 described by its double-walled construction. Cavity portion 80 formed therebetween becomes filled with the contained liquid when the container is tilted for drinking. Accordingly, with the users lips about mouthpiece 22** which is formed of a thin layer of material approximately 10 mils in thickness, the user is able to sense through his lips, the temperature of the contained liquid.

Figure 3:
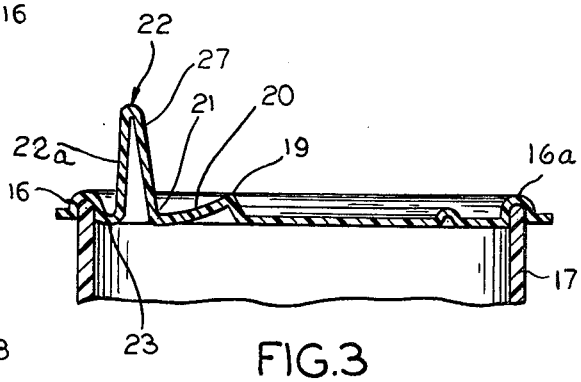
FIG. 3 is a sectional view of the lid of FIG. 2 and a portion of the container showing the structure of the mouthpiece.

The construction is particularly seen in FIG. 3, where section 23 is shown lying between the peripheral ridge **16*a* and the basin defining double-walled mouthpiece 22. Preferably mouthpiece 22** extends upwardly at a position substantially normal to the lid.

The mouthpiece area 13 includes a slit portion 24 extending radially in basin area 20 towards ridge 19. The slit 24 in conjunction with an arcuate slit 26 which is formed substantially at the junction 21 of the inner surface 27 of mouthpiece 22 and surface 20 comprises the integral valve arrangement of the mouthpiece area 13. The essentially arcuate slit 26 extends on both sides of slit 24 and substantially normal thereto. The slits terminate in punched holes, such as hole 25, which prevent tearing of the lid at the termination of the slits.

In FIG. 3 the outer surface 22*a* of wall 22 is shown as being substantially linear.

In FIG. 1 it can be seen that the lower lip abuts outer surface 22*a*. Pressure applied by at least one of the lower lips, forces the valve to the open position. The opening of slot 24 enables air to enter the container and replace the escaping liquid, facilitating the smooth flow of the container's contents.

Figure 4:
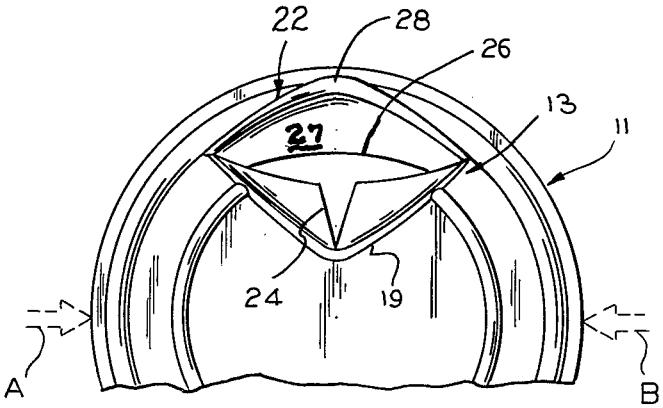
FIG. 4 is a plan view of the lid and container with the valve of the mouthpiece in the open position.

The valve is shown in the open position in FIG. 4. As shown in FIG. 4, the opening may be accomplished by the application of pressure to opposite sides of the container 11, as indicated by arrows A and B. Thus, the valve can be opened by the lips of the drinker, or by applying pressure to opposite sides of the container or by the combination of the two, as may be desirable in the case of thick or dense liquids, such as malts or shakes. If the container is inadvertently tipped, the valve remains closed and the liquid is kept from spilling. Peak 28 of mouthpiece 22 is also shown in FIG. 4.

While drinking from the container it is easy to control the rate of flow of the liquid going into the user's mouth, because of the proximity of the valve to the lips. Also, because of the proximity of the valve to the lips of the user, there is no dribbling of the liquid during the drinking process.

Figure 5:
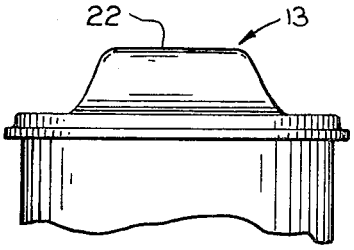
FIG. 5 is a frontal view of the first embodiment of the lid and a portion of the container showing the preferred shape of the mouthpiece.
Figure 2:
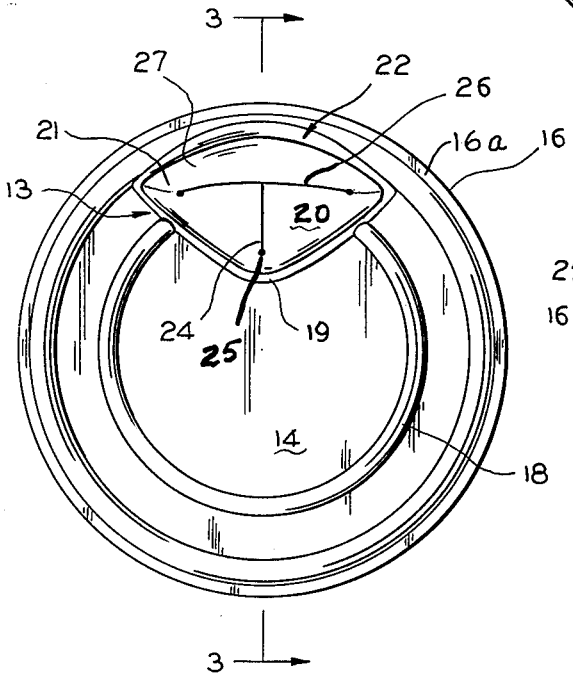
FIG. 2 is a plan view of the container with one embodiment of the lid thereon showing the valve in a closed position.

As shown in FIG. 5, the mouthpiece 22 is sufficiently wide to enable comfortable use of mouthpiece area 13 and to aid in preventing any dribbling during the drinking process.

Figure 6:
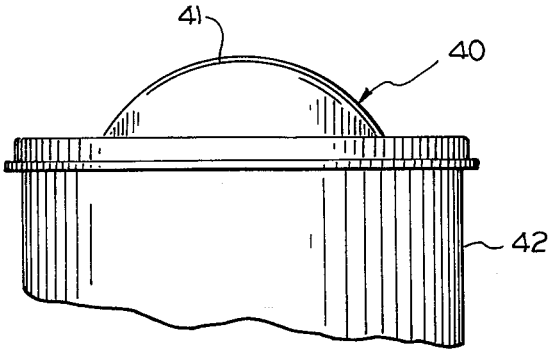
FIG. 6 is a partial front elevational view of a container having attached thereto another embodiment of the invention.

Mouthpiece area 40, which utilizes a flapped lid, is designed particularly for use with hot beverages is shown in FIG. 6 atop container 42. Mouthpiece 41 is substantially equivalent to mouthpiece 22 of the first embodiment.

Figure 7:
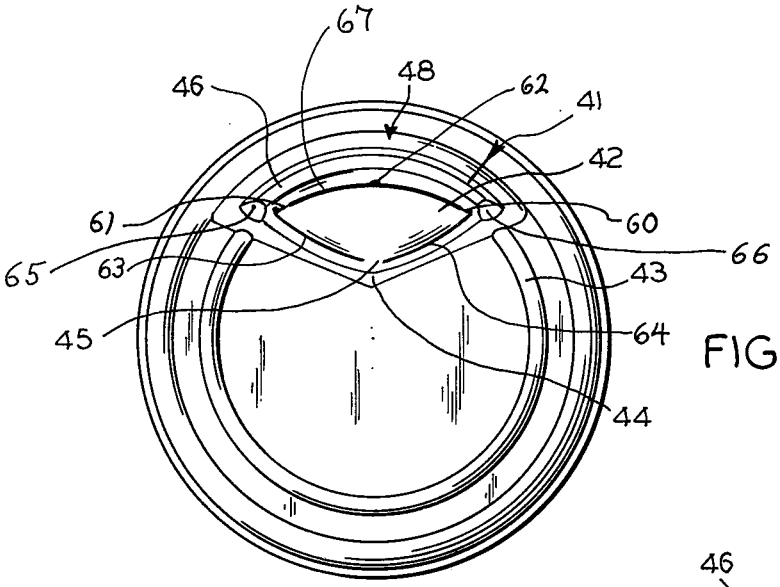
FIG. 7 is a top plan view of said second embodiment of lid showing a flapped valve structure in its sealed position before the "breakaway shoulders" immediately surrounding the flap member are perforated to permit hinged action about the hinge portion.

As shown in FIG. 7, mouthpiece 41 with upper edge 46 emanates in a substantially vertical position from container lid 40, at wedge shaped area 48.

Wedge shaped area 48 is sufficiently large to enable the user to tip the capped cup and not spill the contents without tilting his head an amount that would prevent the user's eyes from looking directly ahead. Thus, the user could drink coffee and still drive safely.

Proximate to mouthpiece 41, at the point where it emanates from the lid 40, is flapped valve portion 82 which is sealed, in its closed position, alongside the portion of the lid at the base of mouthpiece 41 through a series of "breakaway" shoulders 63-64-67, which are continuous about flap 82 up to hinge portion 45.

Breakaway attachment members such as members 60 and 61 comprising minute breakable slivers assist in maintaining the flap 82 in its sealed position together with formed hinge portion 45.

Upon placing pressure about the container and in turn upon the sides of the lid or directly on wedge shaped area 48, attachment slivers 60 and 61 breakaway from affixation with the rest of the lid, permitting flap 42 to be urged downwardly about hinge portion 45.

Figure 8:
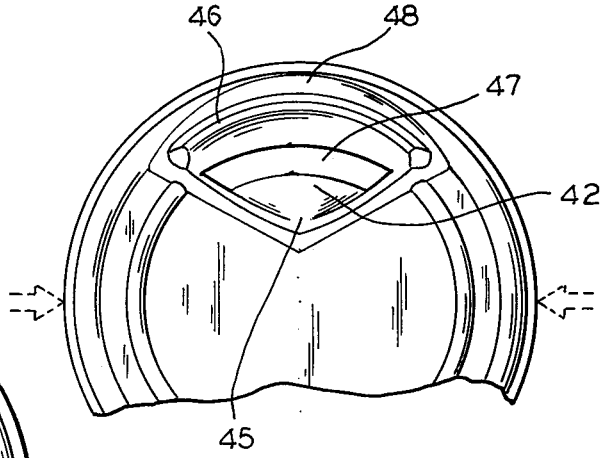
FIG. 8 is a top plan view of the second embodiment of lid showing the flapped valve structure in its open position.

Entry aperture 47 of this flapped embodiment is shown formed in FIG. 8 after pressure has been applied as to the container or lid indicated by the direction of the arrows. Flap 82 retains its position about hinge 45 so as to maintain the formation of the aperture for facilitated insertion by the user of sugar and cream, for example, into hot coffee. Mouthpiece 41 further cools such hot beverages as they are poured over the mouthpiece en route to consumption by the user.

The flap defining scored lines 63 and 64 may be eliminated when the wedge shaped area 48 terminates in truncated sections 65-66. The truncated sections enable the wedge shaped area 48 to rotate about an axis through the truncated sections to provide an opening along line 67.

Figure 9:
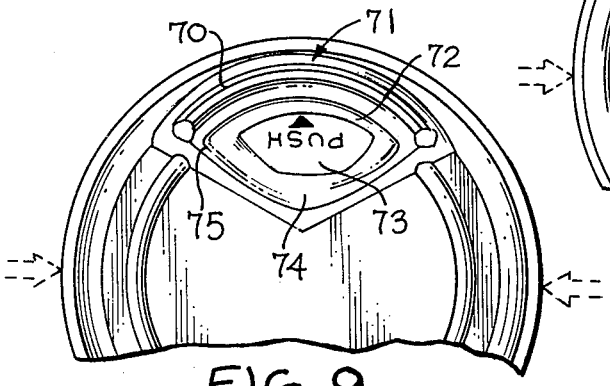
FIG. 9 is a top plan view of another embodiment of the invention wherein a cup-shaped flapped valve is utilized.

An additional flapped embodiment of the invention is shown in FIG. 9 wherein mouthpiece area 71, mouthpiece 70 and cup-shaped flap 72 are shown. Breakaway shoulder 75 surrounds a substantial portion of cup-shaped flap 72 to permit flap 72 to be hingedly pivoted about pivot hinge 74. Cup-shaped flap 72 elevates towards its center to upper region 73 at which point the user's finger or lips may apply pressure to snap the flap away from its closed position inwardly towards the interior of the container. Through such a construction, any "wave action" of the liquid within the container is effectively dampened, and any splashing of the liquid against the cup-shaped flap serves to more effectively replace the flap to its closed position to prevent inadvertent spilling. When chilled liquids are maintained within the container, the cup-shaped flap serves to more effectively preclude the release of cubes, chips or flakes of ice through the aperture which is formed equivalent to that shown in FIG. 8.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. An improved lid for drinking containers, said lid comprising:

a substantially disc-like main body portion for covering the open end of a drinking container having a beverage contained therewithin;

means for attaching said disc-like main body portion to said open end of the drinking container;

integrated double-walled mouthpiece means emanating upwardly from said disc-like main body portion at one side thereof;

a portion of said mouthpiece means shaped to fit between the lips of a user;

said double-walled mouthpiece means having a cavity portion therein into which said beverage may flow formed of a relatively thin material to allow the sampling of the beverage temperature by said user's lips;

valve means located in said disc-like main body portion proximate to the base of said mouthpiece means for alternative release and containment of the beverage located within the container, said valve means having a closed position and an open position to accommodate said alternative containment and release of said beverage respectively whereby said beverage in said container is kept from spilling while enabling the user to alternatively release liquid from the container for said user's consumption.

2. The invention according to claim 1 in which said mouthpiece emanates at a substantially normal position to said disc-like main body portion;

said position being disposed towards the position of said user;

said position further facilitating the guiding of said beverage when said user tilts the container lid assembly as said beverage is released from the container through said lid.

3. The invention according to claim 2 in which said shape of said mouthpiece is curvilinear for fitting between said lips of said user.

4. The invention according to claim 3 wherein at least a part of said valve means includes a first slit having a circumferential shape substantially close in shape to the curvilinear shape of said mouthpiece;

said first slit being positioned at the base of said mouthpiece and extending substantially the length of said mouthpiece; and a second slit extending radially from said first slit towards the center of said main body portion.

5. The invention according to claim 4 where said second slit is substantially normal to said first slit.

6. The improved lid according to claim 1 wherein the invention further comprises a basin-like indentation at the base of said mouthpiece which extends towards the center of said disc-like main body portion.

7. The invention according to claim 6 wherein said basin is described by interior ridge means having a quasi-triangular shape.

8. The invention according to claim 1 wherein said valve means comprises moveable flap means;

said flap means being hinged and positioned proximate to said mouthpiece so as to be moveable between said closed and open positions; and said flap means being capable of retaining its open position once said flap means are urged to said open position by said user.

9. The invention according to claim 8 in which said moveable flap means is maintained in said closed position by a plurality of breakaway attachment shoulders;

said attachment shoulders having a breakaway construction for releasing said moveable flap means upon their penetration from its closed sealing position relative to said main body portion.

10. The invention according to claim 9 in which said breakaway attachment shoulders are responsive to pressure exerted about the peripheral sides of the lid so as to breakaway and release said flap means from its sealing position proximate to said main body portion.

11. The invention according to claim 10 in which said moveable flap means has a quasi-triangular shape;

both said mouthpiece and the top of said quasi-triangular flap means having substantially equivalent circumferential shapes;

said flap means capable of being urged downwardly to produce a substantially circumferentially shaped aperture through which condiments for said beverage may be added and through which said beverage is released upon tilting of said container, for consumption by said user;

said mouthpiece further positioned to enable cascading of said beverage over said mouthpiece just prior to consumption by said user for actively reducing the temperature of said released beverage before said consumption.

12. The improved lid according to claim 8 wherein the invention further comprises a basin-like indentation at said base of said mouthpiece which extends towards the center of said disc-like main body portion.

13. The invention according to claim 8 in which said flap means is substantially cup-shaped with the open portion of said cup-shape facing downwardly into said container when said lid is in place atop the open end of said drinking container, said cup-shape of said flap means more effectively sealing said valve means in response to splashing of said beverage.

14. The invention according to claim 1 wherein said relatively thin material proximate to the cavity portion of said mouthpiece is 10 mils in thickness.

15. An improved lid for drinking containers, said lid comprising:

a substantially disc-like main body portion for covering the open end of a drinking container having a beverage contained therewithin;

means for attaching said disc-like main body portion to said open end of the drinking container;

integrated double-walled mouthpiece means emanating upwardly from said disc-like main body portion at one side thereof;

a portion of said mouthpiece means shaped to fit between the lips of a user;

said double-walled mouthpiece means having a cavity portion therein into which said beverage may flow formed of a relatively thin material to allow the sampling of the beverage temperature by said user's lips;

valve means located in said disc-like main body portion proximate to the base of said mouthpiece means for alternative release and containment of the beverage located within the container, said valve means having a closed position and an open position to accommodate said alternative containment and release of said beverage respectively whereby said beverage in said container is kept from spilling while enabling the user to alternatively release liquid from the container for said user's consumption;

said valve means comprising a cup-shaped flap means hinged and positioned proximate to said mouthpiece so as to be moveable between said closed and opened positions;

said flap means being capable of retaining its opened position once said flap means are urged to said open position by said user, said cup-shaped flap means having the open portion of said cup shape facing downwardly into said container when said lid is in place atop said drinking container.

* * * * *

UNITED STATES PATENT AND TRADEMARK OFFICE

CERTIFICATE OF CORRECTION

PATENT NO. : 4,245,752

DATED : January 20, 1981

INVENTOR(S) : Andrew B. Prueher

It is certified that error appears in the above–identified patent and that said Letters Patent are hereby corrected as shown below:

Column 3, Line 14 — Delete "silvers" and insert instead--slivers--.

Signed and Sealed this

*Second* Day of *June 1981*

[SEAL]

*Attest:*

RENE D. TEGTMEYER

*Attesting Officer*

*Acting Commissioner of Patents and Trademarks*